United States Patent [19]

Oelsch

[11] Patent Number: 4,743,722

[45] Date of Patent: May 10, 1988

[54] TOUCH CONTACT SWITCH WITH ARCHED SWITCHING FILM

[75] Inventor: Jurgen Oelsch, Hohenroth, Fed. Rep. of Germany

[73] Assignee: Preh Elektrofeinmechanische Werke Jakob Preh Nachf. GmbH & Co., Bad Neustadt/Saale, Fed. Rep. of Germany

[21] Appl. No.: 928,724

[22] Filed: Nov. 7, 1986

Related U.S. Application Data

[63] Continuation of Ser. No. 616,480, Jun. 1, 1984, abandoned.

[30] Foreign Application Priority Data

Jun. 3, 1983 [DE] Fed. Rep. of Germany ..... 3320116

[51] Int. Cl.[4] ..... H01H 3/12

[52] U.S. Cl. ..... 200/159 B; 200/5 A

[58] Field of Search ..... 200/159 B, 5 A

[56] References Cited

U.S. PATENT DOCUMENTS 4,071,718 1/1978 Harden ..... 200/159 B
4,382,165 5/1983 Balash et al. ..... 200/159 B
4,423,294 12/1983 Walser et al. ..... 200/159 B

FOREIGN PATENT DOCUMENTS 2903898 8/1979 Fed. Rep. of Germany .
2847278 5/1980 Fed. Rep. of Germany ... 200/159 B
2902769 7/1980 Fed. Rep. of Germany .
3006591 8/1981 Fed. Rep. of Germany .
3025024 1/1982 Fed. Rep. of Germany .

*Primary Examiner*—Renee S. Luebke
*Attorney, Agent, or Firm*—Woodcock Washburn Kurtz Mackiewicz & Norris

[57] ABSTRACT

A switch designed to be activated by touch contact has a switching chamber with contact surfaces on opposite sides thereof. A flexible switching film carries one of the contact surfaces and is arched over one side of the chamber. In order to prevent an increase in length of the switching film due to climatic effects from leading to incorrect switching, the switching film has at least one punctiform or linear deformation placed so as to cause the film to arch away from the opposite side of the chamber.

16 Claims, 1 Drawing Sheet

TOUCH CONTACT SWITCH WITH ARCHED SWITCHING FILM

This is a continuation of application Ser. No. 616,480, filed June 1, 1984, and now abandoned.

BACKGROUND OF THE INVENTION

The present invention pertains to touch contact switches and, in particular, a switch having a switching chamber with a flexible, elastic switching film carrying a first contact area on one side of the chamber, and a second contact area on the opposite side of the chamber, the areas being contacted when the switching film is touch pressed.

DESCRIPTION OF THE PRIOR ART

A touch contact switch having an arched switching film is described in DE-OS [West German Offenlegungsschrift] No. 29 02 769. There, a snap-in effect is said to be achieved by the arching. A similar touch contact switch is described in DE-PS [West German Patent] No. 30 25 024, where the necessary switching distance is said to be ensured by the arch of the switching film. According to this disclosure the arch is formed with a cupola shape in the switching film prior to the application of the switching film on the switching chamber. The manufacture and the assembly of such a switching film is expensive.

Touch contact switches in which the switching film spans over the switching chamber in a flat plane are described in DE-OS [West German Offenlegungsschrift] No. 29 03 898 and in DE-OS No. 30 06 591. The necessary switching distance is created by a spacing film.

Generally, in touch contact switches, the switching film is mounted in a plane substantially parallel to the bottom of the switching chamber. If the switching film is exposed to moisture and elevated temperature, it expands. It has been found that the increase in length associated with the expansion can lead to the switching film arching inward into the switching chamber. This can lead to the contact of the two contact surfaces which can thus cause incorrect switching. While it would be possible to increase the switching distance in order to prevent such incorrect switching, this is undesirable in many cases because it would increase the overall thickness of the touch contact switch, requiring stronger operating forces.

SUMMARY OF THE INVENTION

It is an object of the present invention to create a touch contact switch of the type having a switching film which carries a contact surface, in which an increase in the length of the switching film does not reduce the switching distance of the contact surfaces, the switching film having a pre-deformation which causes arching of the film away from the other contact surface, the deformation being of a design which can be simply and reliably produced.

The above object is solved according to the present invention with a touch contact switch having a switching chamber and a switching film with at least one punctiform or linear deformation which represents a permanent bend independent of the pressing down of the switching film, as a result of which the switching film is urged to arch away from the opposite side of the switching chamber. Due to the bend the switching film has a slight concave arch when viewed from the switching chamber and accordingly the arch need not span over the switching chamber uniformly. Under normal conditions, the arch does not significantly increase the switching distance of the contact surfaces, but serves to deflect the switching film away from the plane in the zone of the switching chamber in such a way that in the case of an increase in the length of the switching film, e.g., as a consequence of high humidity or elevated temperature, it causes the arch to increase so that the switching distance of the contact surfaces becomes greater. By this arrangement it is thus ensured that the contact surfaces do not come nearer to each other in the case of an increase in film length. The consequence of this is that the switching distance and the overall height of the touch contact switch can be designed smaller than they are according to the state of the art. Further, the switching chamber does not have to be opened to implement this advantageous feature.

Advantageous embodiments of the present invention are apparent from the claims and from the following description of examples of embodiments.

DESCRIPTION OF THE PREFERRED EMBODIMENT

Figure 1:
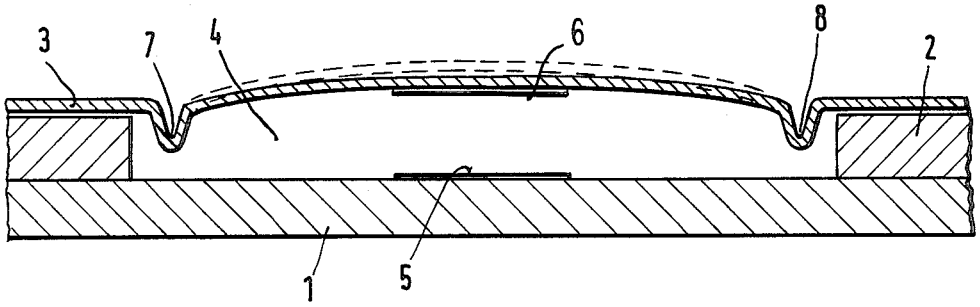
FIG. 1 shows a cross section of an enlarged detail of a touch contact switch.

A touch contact switch is designed as a film switch. The switch has a base film 1, a spacing film 2 and a switching film 3. The spacing film 2 has perforations or openings forming one or more switching chambers 4, as shown in FIG. 1. The base film 1 carries a contact surface 5 in the switching chamber 4. The switching film 3, positioned on the opposite side of the chamber from the base film, is provided with a contact surface 6. The touch contact switch is designed for very weak operating forces which are below 0.5 N and especially below 0.2 N. Such low operating forces are sufficient for contacting, if the flexible, elastic switching film 3 and the spacing film 2 are thin and the cross section of the switching chamber 4 is large. The thickness of the switching film 3 is in the range of approximately 75 microns to 150 microns. The thickness of the spacing film 2 is about 50 microns to 200 microns. The base of the switching chamber 4 is suitably about 10 mm to 20 mm. In the area of the switching chamber 4 the switching film 3 has two deformations 7 and 8. These are within, i.e., extend into the switching chamber 4 next to the contact surfaces 5 and 6. The switching chambers communicate with one another via air equalizing channels 4'.

The deformations 7 and 8 are salient, nonreversible bends of the switching film 3. In principle, the bends are prepared after the films 1, 2 and 3 are glued together, by pressing in or embossing film 3 with a pointed tool directed from the top. Each impression is preferably deeper than the film thickness. However, an embossing or deformation that is small relative to the film thickness can also be sufficient to achieve the desired goal, and is within the scope of the invention. The switching film 3 must not be slit open by the tool in the process of forming the deformations. As a result of the deformations 7 and 8, the switching film 3 is designed to arch up following the bend of the deformation.

If the length of the switching film 3 increases due to the absorption of moisture or under the effect of elevated temperature, the film elongation is constrained to have the effect of reinforcing the arch, as is suggested schematically in FIG. 1 by the broken lines. As is seen, the switching distance between the contact surfaces 5 and 6 is prevented from decreasing as a result of the increase in film length, so that incorrect switchings due to unintended contacting between the contact surfaces 5 and 6 due to climatic effects are prevented from occurring. The deformations 7 and 8 dispose the arching away from the contact surface 5.

Figure 2:
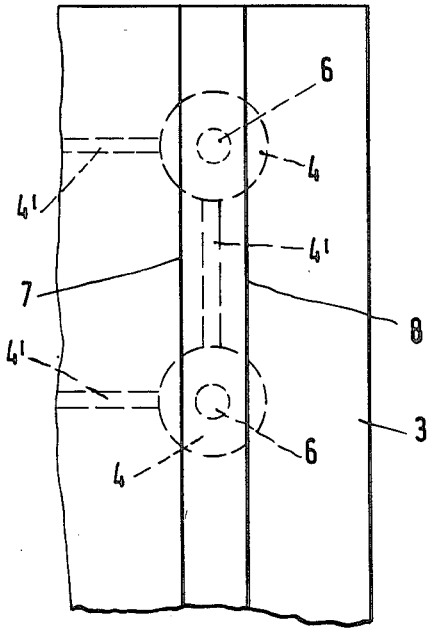
FIG. 2 shows a top view of a detail of the touch contact switch.

In FIG. 2 the deformations 7 and 8 are prepared as linear bends which extend in a straight line continuously over a plurality of switching chambers 4. Even though the deformations 7 and 8 have no function between the switching chambers 4, they can be prepared in an especially simple manner over the entire switching film 3, e.g., the tool with which the lines are made does not need to be lifted off the film between the switching chambers 4.

Figure 3:
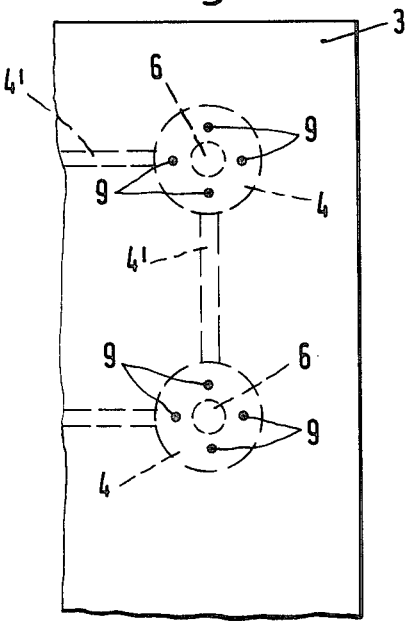
FIG. 3 shows another embodiment of the touch contact switch of this invention in top view.

The deformations are prepared as punctiform bends 9 in FIG. 3. While four deformations per chamber are illustrated, it is understood that this is illustrative only, and any number of such deformations can be employed which provide the arching as described above.

Numerous further embodiments of the deformations are within the scope of the present invention. For example, the deformations on the switching film 3 can also have an arc-shaped or curvilinear pattern. Combinations of punctiform, linear and/or curvilinear deformations can also be provided on one switching film. It is not necessary for the deformation to be symmetrical to the switching chamber 4, as is shown in the figures. Asymmetrically arranged deformations may be used which produce an arching effect in their vicinity.

To contact the contact surfaces 5 and 6 the switching film 3 is pressed into the switching chamber 4 with a weak operating force. The deformations 7 and 8 or 9 do not practically change their shape in this process, and have no substantial influence on the switching behavior.

I claim:

1. A touch contact switch having a switching chamber and a flexible, elastic switching film extended over said chamber, a first electrical contact surface located within said switching chamber and a second contact surface located on said switching film, said contact surfaces being positioned to contact each other when said switching film is pressed, characterized in that said switching film has a plurality of punctiform deformations which constitute permanent bends independent of the pressing down of said switching film, said switching film being slightly arched away from said first contact surface as a consequence of said bends.

2. The touch contact switch apparatus in accordance with claim 1, characterized in that said punctiform deformations are deeper than a thickness of said switching film.

3. The touch contact switch apparatus in accordance with claim 1, characterized in that said punctiform deformations are located entirely within said switching chamber and outside said contact surfaces.

4. The touch contact switch apparatus in accordance with claim 3, characterized in that said punctiform deformations are deeper than a thickness of said switching film.

5. Touch contact switch apparatus comprising a plurality of contact switches, said apparatus having a base film and means for forming a plurality of switching chambers positioned above said base film, each of said switching chambers corresponding to one of said switches, a flexible switching film extended over each of said chambers, each of said chambers having a first electrical contact surface located on said base film and a second electrical contact surface located in opposing relation to said first electrical contact surface on said switching film and within said chamber, said switching film having a continuous linear deformation, said continuous linear deformation providing a permanent linear deformation for each of said plurality of switches, said permanent linear deformation for each of said switches being proximate to said switching chamber for each of said switches and placed so as to cause said switching film to arch away from said chamber when said switching film increases in length due to external conditions.

6. The touch contact switch apparatus as described in claim 5, wherein said permanent linear deformation for each of said switches is located on said switching film over each of said switching chambers and outside said contact surfaces.

7. The touch contact switch apparatus as described in claim 5 further comprising a plurality of air equalizing channels, each said air equalizing channel connecting two adjacent switching chambers.

8. The touch contact switch apparatus as described in claim 7, wherein said permanent linear deformation for each of said switches is located on said switching film over each of said switching chambers and outside said contact surfaces.

9. The touch contact switch apparatus as described in claim 8, wherein said linear deformation for each of said switches extends down into said chamber by a distance greater than a thickness of said switching film.

10. The touch contact switch apparatus as described in claim 5, wherein said permanent linear deformation for each of said switches extends down into each of said switching chambers by a distance greater than a thickness of said switching film.

11. The touch contact switch apparatus as described in claim 10 further comprising a plurality of air equalizing channels, each said air equalizing channel connecting two adjacent switching chambers.

12. The touch contact switch apparatus as described in claim 10 wherein said permanent linear deformation for each of said switches is located on said switching film over each of said switching chambers and outside said contact surfaces.

13. A touch contact switch apparatus comprising a plurality of contact switches, said apparatus having a base film and means for forming a plurality of switching chambers positioned above said base film, each of said switching chambers corresponding to one of said switches, a flexible switching film extended over each of said chambers, each of said chambers having a first electrical contact surface located on said base film and a second electrical contact surface located in opposing relation to said first electrical contact surface on said switching film and within said chamber, said switching film having a permanent deformation proximate to each of said switching chambers and extending down into each of said chambers by a distance greater than a thickness of said switching film and placed so as to cause said switching film to arch away from each of said chambers when said switching film increases in length due to external conditions.

14. The touch contact switch apparatus as described in claim 13, wherein said permanent deformation is located on said switching film over each of said switching chambers and outside said contact surfaces.

15. The touch contact switch apparatus as described in claim 13 further comprising a plurality of air equalizing channels, each said air equalizing channel connecting two of said switching chambers.

16. The touch contact switch as described in claim 15, wherein said permanent deformation is located on said switching film over each of said switching chambers and outside said contact surfaces.

* * * * *